US007490740B2

(12) United States Patent
Robins et al.

(10) Patent No.: US 7,490,740 B2
(45) Date of Patent: Feb. 17, 2009

(54) PERSONAL HYDRATION SYSTEM

(75) Inventors: Duncan G. Robins, McKinleyville, CA (US); Micah T. Somers, Minneapolis, MN (US); Nathaniel R. Hallee, Minneapolis, MN (US)

(73) Assignee: Fiskars Brands, Inc., Madison, WI (US)

( * ) Notice: Subject to any disclaimer, the term of this patent is extended or adjusted under 35 U.S.C. 154(b) by 612 days.

(21) Appl. No.: 10/840,751

(22) Filed: May 6, 2004

(65) Prior Publication Data

US 2005/0029319 A1 Feb. 10, 2005

Related U.S. Application Data

(60) Provisional application No. 60/478,372, filed on Jun. 12, 2003, provisional application No. 60/468,897, filed on May 8, 2003.

(51) Int. Cl.
*B67D 5/64* (2006.01)

(52) U.S. Cl. ..... 222/175; 224/148.2

(58) Field of Classification Search ..... 222/990, 222/105, 386.5, 529, 175; 251/900, 342; 324/148.1–148.7; 220/703, 711
See application file for complete search history.

(56) References Cited

U.S. PATENT DOCUMENTS

| | | | | |
|---|---|---|---|---|
| 2,808,965 | A | 10/1957 | Graphia III, et al. | |
| 3,348,741 | A * | 10/1967 | Wooten | 222/175 |
| 4,090,650 | A * | 5/1978 | Gotta | 224/148.2 |
| 4,193,518 | A | 3/1980 | Holmes | |
| 4,573,631 | A | 3/1986 | Reeves | |
| 4,850,566 | A | 7/1989 | Riggert | |
| 4,852,781 | A | 8/1989 | Shurnick et al. | |
| 4,948,023 | A | 8/1990 | Tripp | |
| 4,982,854 | A | 1/1991 | Ichimiya | |
| 5,005,717 | A | 4/1991 | Oilar | |
| 5,060,833 | A | 10/1991 | Edison et al. | |
| 5,085,349 | A | 2/1992 | Fawcett | |
| 5,143,390 | A * | 9/1992 | Goldsmith | 280/201 |
| 5,263,618 | A | 11/1993 | Talavera | |
| 5,427,290 | A | 6/1995 | Thatcher | |
| 5,524,612 | A | 6/1996 | Chen | |
| 5,571,260 | A | 11/1996 | Krug | |
| 5,607,087 | A * | 3/1997 | Wery et al. | 222/610 |

(Continued)

FOREIGN PATENT DOCUMENTS

WO WO 2004/100708 A2 11/2004

OTHER PUBLICATIONS

U.S. Appl. No. 10/839,982, filed May 6, 2004, 41 pages.

(Continued)

*Primary Examiner*—Lien M. Ngo
(74) *Attorney, Agent, or Firm*—Foley & Lardner LLP

(57) ABSTRACT

A personal hydration assembly is configured to deliver fluid to a user. The assembly includes a reservoir having a shell defining a volume configured to contain a quantity of fluid. A holder is configured to interconnect the shell and the user. A fluid delivery system is coupled to the shell and is configured to transport fluid from the reservoir to the user. The shell is configured to resist deformation and maintain a first shape when fluid is stored within the shell. The shell is configured to permit deformation into a second shape to reduce the volume when fluid is transported from the shell to the user.

25 Claims, 13 Drawing Sheets

U.S. PATENT DOCUMENTS 5,645,404 A * 7/1997 Zelenak ..... 417/1
5,722,573 A * 3/1998 Carnel ..... 224/148.2
5,727,714 A 3/1998 Fawcett
5,730,336 A 3/1998 Lerner
D398,776 S 9/1998 Fawcett
5,803,333 A 9/1998 Fawcett
5,806,726 A 9/1998 Ho
5,911,406 A 6/1999 Winefordner et al.
5,913,456 A 6/1999 Dikeman
D411,915 S 7/1999 George
5,971,357 A 10/1999 Denton et al.
6,032,831 A 3/2000 Gardner et al.
6,039,305 A 3/2000 Hoskins et al.
6,062,435 A 5/2000 Hess, III
6,070,767 A 6/2000 Gardner et al.
6,199,729 B1 3/2001 Drzymkowski
6,241,135 B1 6/2001 Thatcher
6,283,344 B1 * 9/2001 Bradley ..... 224/148.2
6,364,168 B1 4/2002 Gardner et al.
6,409,048 B1 6/2002 Belzeski
6,497,348 B2 12/2002 Forsman et al.
6,666,360 B1 12/2003 Swank
6,675,998 B2 1/2004 Forsman et al.
6,971,562 B2 * 12/2005 Willows et al. ..... 224/148.4
2002/0011583 A1 1/2002 Getzewich et al.
2002/0043513 A1 4/2002 Lipson
2002/0092858 A1 7/2002 Bowman
2002/0092877 A1 7/2002 Bowman
2002/0112502 A1 8/2002 Fiore, Jr.
2002/0113101 A1 8/2002 Skillem
2002/0179647 A1 * 12/2002 Hall et al. ..... 222/175
2003/0168470 A1 9/2003 Choi et al.
2003/0218035 A1 11/2003 Willows et al.
2004/0000570 A1 1/2004 Forsman
2004/0007605 A1 1/2004 Mares
2004/0045980 A1 3/2004 Robins

OTHER PUBLICATIONS

Annex to Form PCT/ISA/206, Communication Relating to the Results of the Partial International Search, based on PCT International Application No. PCT/US2006/001278 (2 pp.).
Order #1, Order #2, Order #3, Boldt Products, order date Jul. 31, 2003, 3 pages.
BRO Order, Boldt Products, order date Jul. 1, 2003, 1 page.
Lights and Hydration, Dealer Workbook, Fall 2003, 7 pages.
Drink Safe, Boldt, Summer 2003, 2 pages.
Lights and Hydration, Dealer Workbook, Sales Program, Boldt, Jul. 1, 2003, 5 pages.
U.S. Appl. No. 29/222,308, filed Jan. 27, 2005, 9 pages.
U.S. Appl. No. 11/044,989, filed Jan. 7, 2005, 32 pages.
The International Search Report, based on PCT/US2004/014179, date of the mailing of the International Search Report Dec. 20, 2004, (2 pages).

* cited by examiner

FIGURE 5C
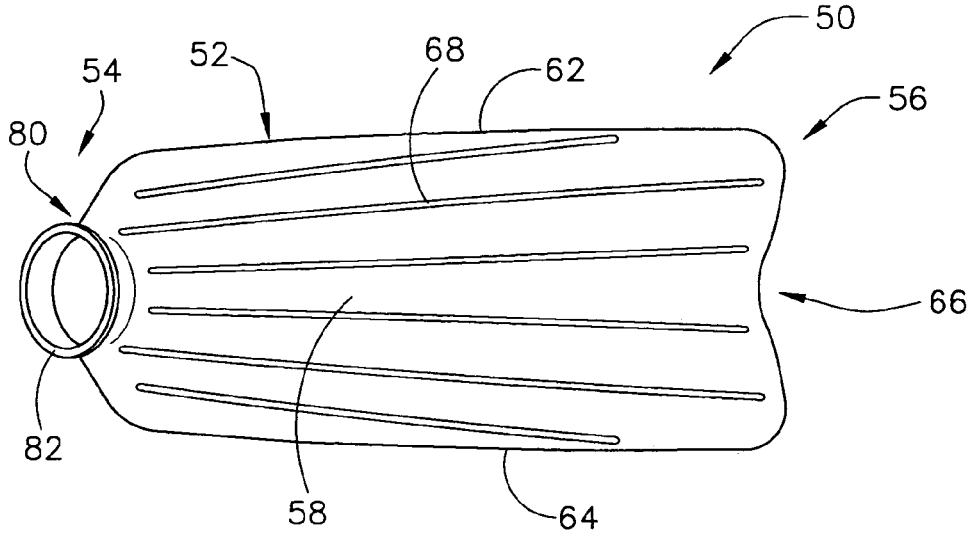
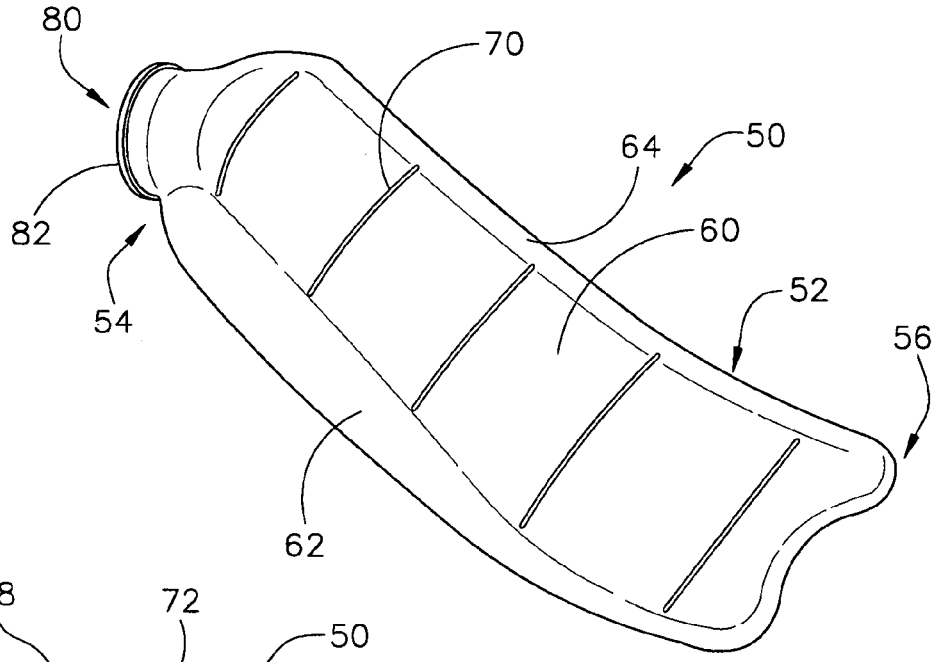
FIGURE 5D
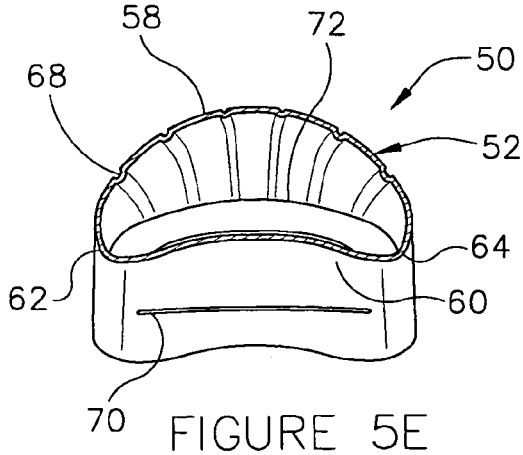
FIGURE 5E

FIGURE 6
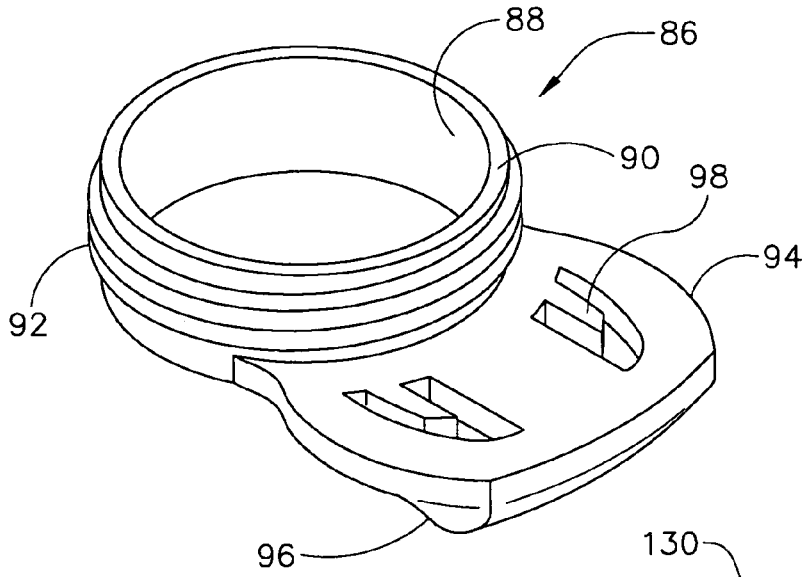
FIGURE 7A
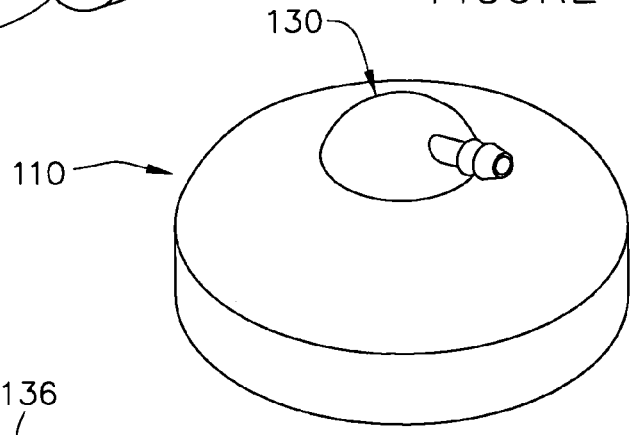
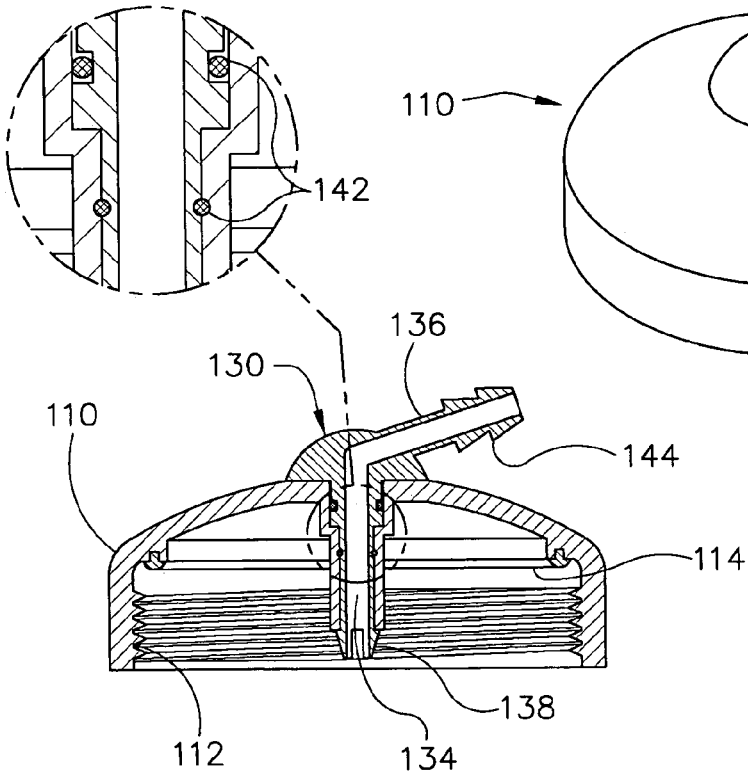
FIGURE 7B
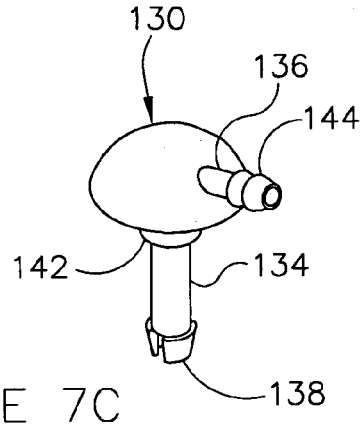
FIGURE 7C FIGURE 10A
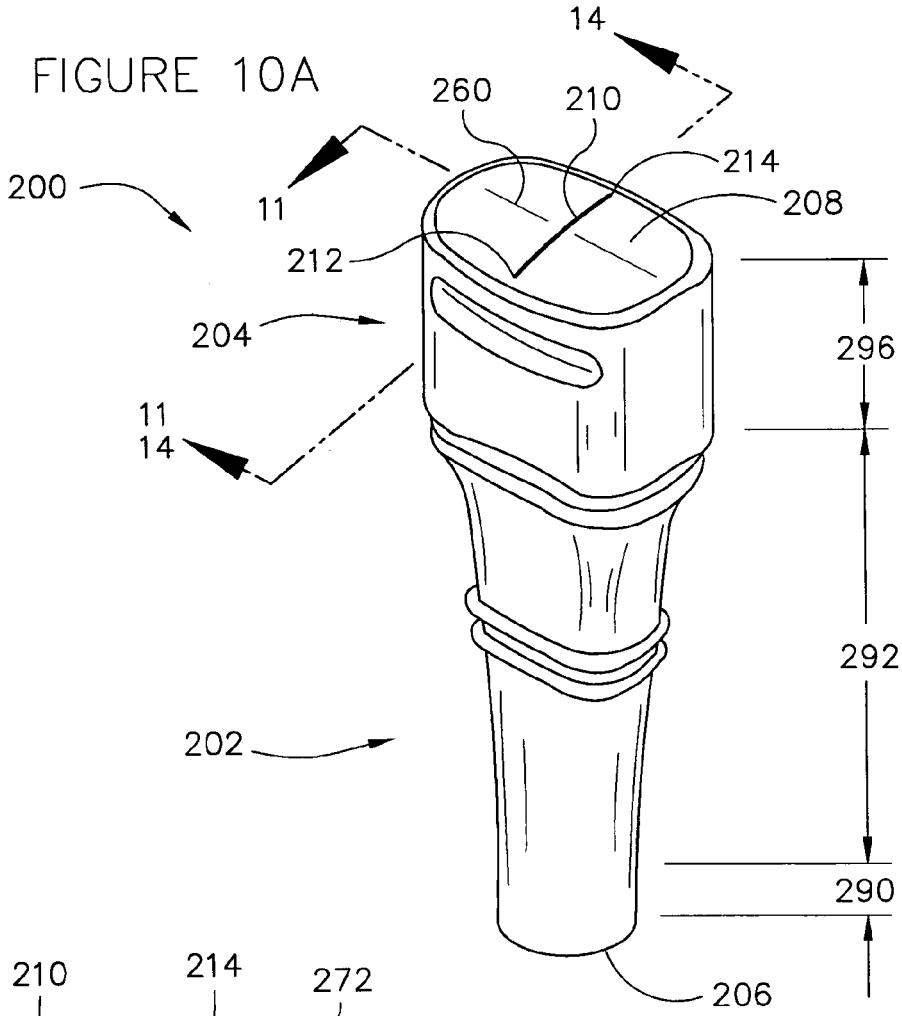
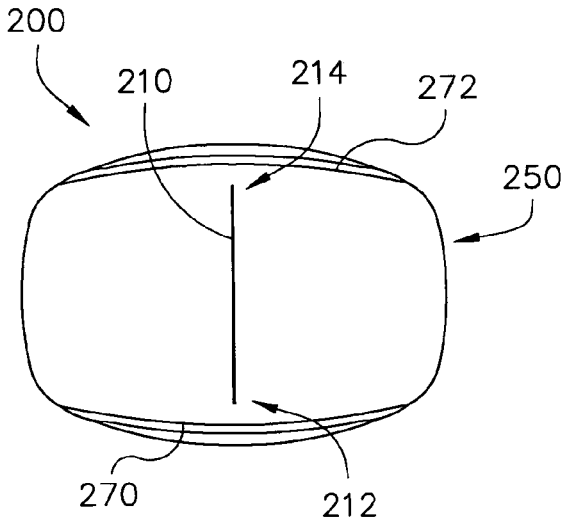
FIGURE 10B
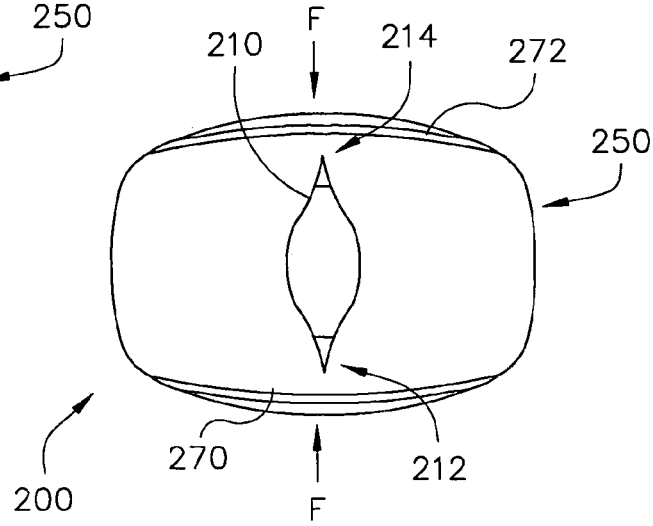
FIGURE 10C FIGURE 12
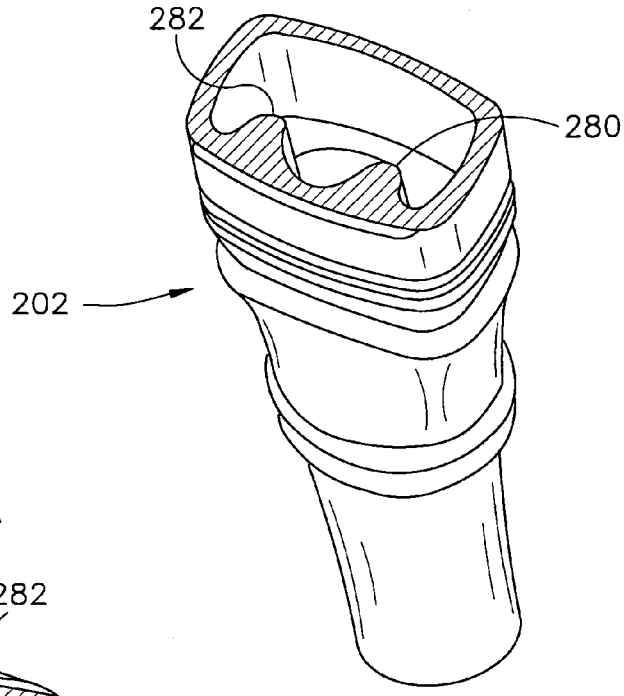
FIGURE 13A
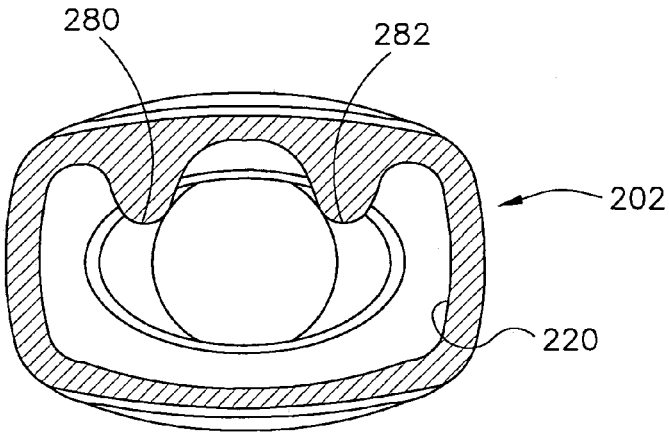
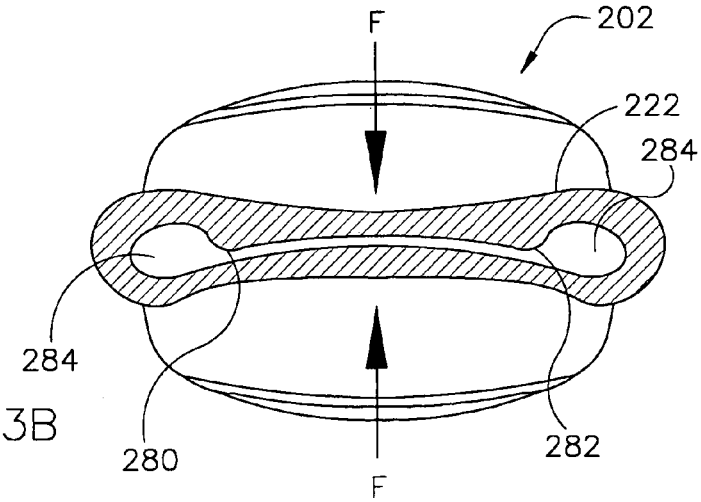
FIGURE 13B FIGURE 14B
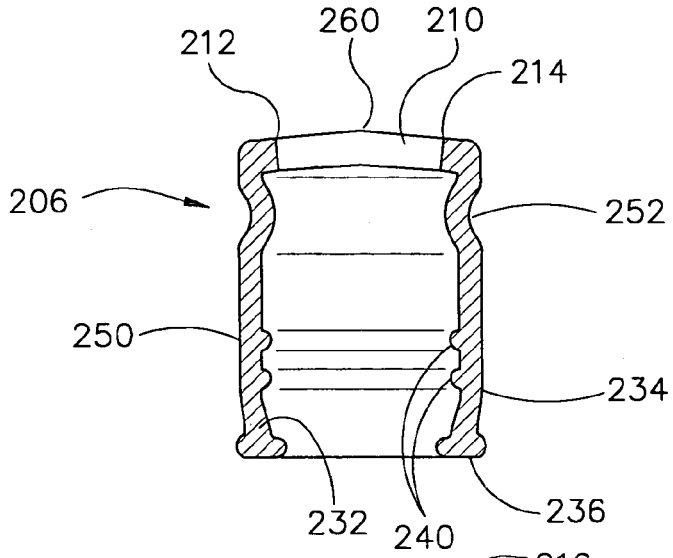
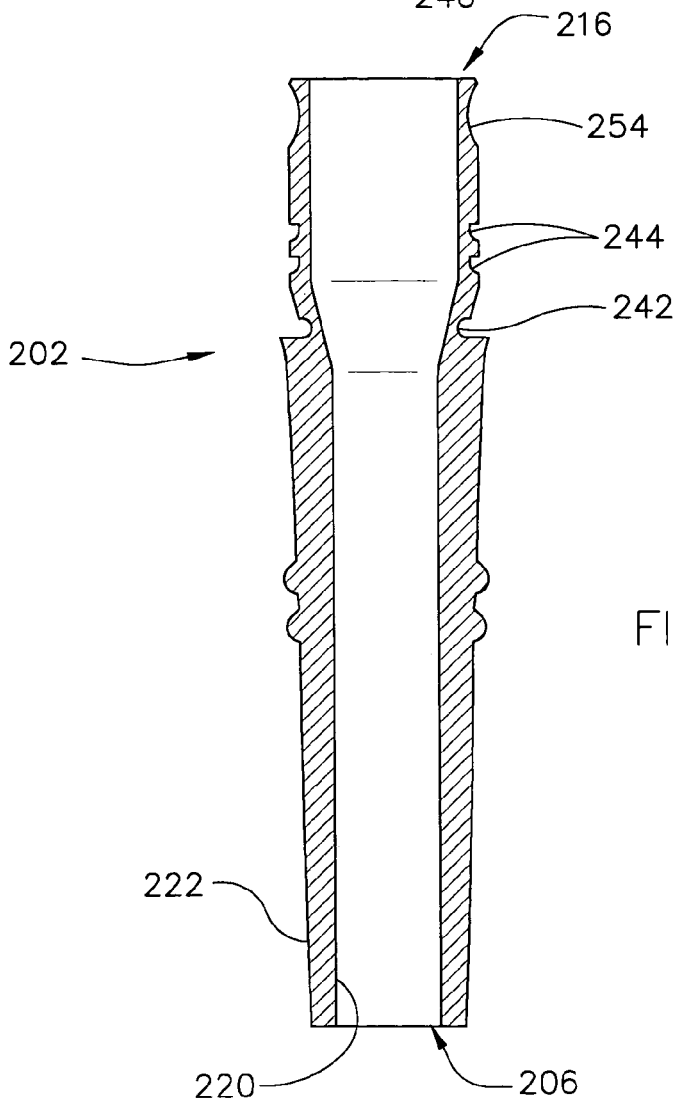
FIGURE 14A

PERSONAL HYDRATION SYSTEM

CROSS-REFERENCE TO RELATED PATENT APPLICATIONS

The present Application claims the benefit of priority as available under 35 U.S.C. § 119(e) to the following applications (which are incorporated by reference): U.S. Provisional Patent Application Ser. No. 60/468,897, filed May 8, 2003, and U.S. Provisional Patent Application Ser. No. 60/478,372, filed Jun. 12, 2003.

FIELD

The present invention relates to personal hydration systems. The present invention relates more particularly to a personal hydration system with a removable fluid reservoir and an improved mouthpiece and valve device.

BACKGROUND

The need for a ready supply of fluids to combat dehydration during strenuous activity is well known. Commonly, people who are working or recreating take periodic refreshment breaks to hydrate themselves. However, such refreshment breaks might not occur frequently enough to properly hydrate a person performing strenuous activities. In addition, it is generally accepted that a person's physical and mental health may be maintained by adequate hydration while working or recreating. Hydration systems for hydrating persons during work and recreation activities have grown in popularity, including participation in non-team oriented sports such as biking, hiking and running, where refreshment breaks may be more difficult to accomplish.

Maintaining proper hydration levels can require the regular ingestion of fluids. The medical and performance enhancing need for regular drinking requires ready access to fluids. Several portable devices have been developed to meet this need. Some devices include containers of rigid or of semi-rigid construction. These devices, such as aluminum canteens and plastic water bottles, are reasonably light, durable and inexpensive. However, they are often awkwardly mounted to a waist belt or in a pocket of a back pack, and thus typically require a user's hand for manipulating the container to access the liquid.

More recently, portable hydration devices have been developed that include a flexible, bag-like (e.g. soft-sided) reservoir to store fluids. This type of reservoir has the benefit of being more comfortable when carried next to the body, and is often configured to be worn on a user's back with a short drinking tube and mouth piece to provide hands-free access to the fluid.

While some improvements have been made in such bag-like systems, the reservoirs of these systems are often expensive and difficult to clean due to their construction. Flexible reservoirs are typically constructed from two sheets of high grade plastic that are bonded or welded together along their edges to create a bag with water-tight seams. These bags then have components attached to them for filling and dispensing fluids, such as an input port with a large threaded neck to fill the bag which ice and water, and an output spout with a bonded or welded drink tube. The resulting reservoir is typically a water-tight, though expensive, assemblage of fused or bonded parts. These assemblages usually have many internal seams and corners that are difficult to clean with conventional methods.

Another feature of the known bag-like devices is the mouthpiece. It is desirable that the mouthpiece acts like a valve configured to open and close at the user's command to provide access to the fluid in the reservoir. For convenience, it is also desirable that the valve operates under the action of a user's mouth. These mouthpieces that include mouth-actuated valves are sometimes referred to as "bite valves." Many designs have been put forward to provide such a mouthpiece. Such mouthpieces typically include multiple parts which move relative to one another, and unitary mouthpieces made from a resilient, deformable material.

It is also desirable that the mouthpiece provides a sufficient flow rate of fluid from the reservoir without undo exertion by the user. To this end, some recent designs have attempted to increase the size of the flow passages by incorporating larger mouth pieces, bigger openings, and improved valve designs. In addition to improving flow rates and ease-of-use, mouthpieces have been developed to reduce the likelihood of leakage when in a "standby" or ready-to-use position.

However, such known mouthpieces tend to have certain disadvantages. For example, efforts to optimize desirable characteristics such as ease-of-use, improved flow rates, and reduced leaking has proven difficult, as these characteristics tend to oppose each other. Thus, for example, while ease-of-use is improved by having decreased mouthpiece thickness, this can result in reduced flow rate due to pinching of the valve. Such known mouthpieces also include variations that are formed in a unitary construction, which also tend to have certain disadvantages, including difficulty in cleaning due to their 'blind' corners and small sizes.

Cleaning has become a more desirable issue for many hydration system users to consider, as the typical user's desire for continuous hydration with liquids that contain dissolved salts or sugars has increased. However, the use of a liquid other than water may, in many of such known systems and in the unitary mouthpiece, cause the system to become contaminated due to trapped residue and accumulation of bacteria.

Previous attempts to address the cleaning problems have tended to provide mouthpieces that are an assemblage of two or more parts. Such mouthpieces tend to be somewhat easier to clean, but usually suffer from any one of more of the following deficiencies: inadequate flow rates, leakage, or difficult to activate by a user's mouth.

Therefore, it would be desirable to provide a personal hydration system that is easier to clean and maintain, and that is less expensive to construct than current bag hydration system devices. It would also be desirable to provide a fluid delivery system that is positionable for a user in a hands-free configuration and that does not require retention in a user's mouth. It would also be desirable to provide a personal hydration system that provides a mouthpiece that reduces leakage, is easily activated, can be easily cleaned and provides sufficient flow rates for the user. It would be further desirable to provide a personal hydration device adapted for convenient use with fluids other than water, and that provides sufficient and controllable quantities of fluid to individuals that are exerting themselves.

Accordingly, it would be desirable to provide a personal hydration system having any one or more of these or other advantageous features.

SUMMARY

One embodiment of the invention relates to personal hydration system for delivering a fluid for consumption by a user. The personal hydration system includes a semi-rigid reservoir and a holder configured to receive the reservoir and couple the reservoir to a user. A fluid delivery system is provided to interface with the reservoir to provide a substantially airtight flow path to transport fluid from the reservoir to the user.

Another embodiment of the present invention relates to an integrally formed reservoir designed to hold a fluid for a personal hydration system that provides fluid to a user. The reservoir includes a body portion having a first side and a second side extending between a first end and a second end. A neck portion extends from the first end of the reservoir and a flange member is formed along, an end of the neck portion, so that the flange member is compressible within a coupling device of the personal hydration system to provide a substantially leaktight connection.

Another embodiment of the present invention relates to a fluid delivery system for transporting fluid to a user from a reservoir coupled to the user by a holder. The fluid delivery system includes an elongated hollow member having a first end that interfaces with the reservoir and a second end that interfaces with the user. A mouthpiece is coupled to the second end of the hollow member to selectively permit passage of fluid to the user. A ductile support member is coupled along the elongated hollow member, so that the mouthpiece is positionable in a desirable location for the user by flexing the support member.

A further embodiment of the present invention relates to a personal hydration assembly for delivering fluid to a user. The personal hydration system includes a reservoir having a shell defining a volume configured to contain a quantity of fluid. A holder is provided to interconnect the shell and the user. A fluid delivery system is coupled to the shell to transport fluid from the reservoir to the user. The shell is designed to resist deformation and maintain a first shape when fluid is not transported to the user and the shell is configured to permit deformation into a second shape to reduce the volume when fluid is transported to a user through the fluid delivery system.

A further embodiment of the present invention includes a cleanable reservoir for use with a personal hydration system. The reservoir includes a body having a first curved side and a second curved side extending between a first end and a second end to define an arc shaped cavity within the body. A neck portion extends at an angle from the first end and provides an opening to the cavity, where the opening provides a substantially direct access path through the angled neck portion to at least a portion of the arc shaped cavity, so that the reservoir is configured to be placed in a generally vertical orientation in a dishwasher device capable of spraying a cleaning fluid through the opening to clean substantially all of the cavity.

A further embodiment of the present invention includes a personal hydration system including a reservoir having a semi-rigid structure configured to contain fluid to be consumed by the user. A backpack to be worn by the user has a first space for receiving the reservoir and a second space to receive objects. The structure of the reservoir provides a frame configured to maintain the backpack in a generally predetermined shape.

BRIEF DESCRIPTION OF THE DRAWINGS

FIGS. 5A-5D are schematic representations of an embodiment of a reservoir for a personal hydration system.

FIG. 5E is a schematic representation of a cross sectional view of the embodiment of FIG. 5C along lines 5E-5E.

FIG. 6 is a schematic representation of a perspective view of a component of the personal hydration.

FIGS. 7A-7C are schematic representations of an embodiment of a cap for a reservoir of a personal hydration system.

FIGS. 10A-10C are a schematic representations of an embodiment of a mouthpiece and valve device for a personal hydration system.

FIG. 12 is a schematic representation of a perspective sectional view along line 12-12 of FIG. 11A.

FIG. 13A is a schematic representation of a cross sectional view along line 12-12 of FIG. 11A in an undeformed position.

FIG. 13B is a schematic representation of the embodiment of FIG. 13A in a deformed position.

FIGS. 14A-14B are a schematic representation of a cross sectional view along lines 14-14 of FIG. 10A.

DETAILED DESCRIPTION

Figure 1:
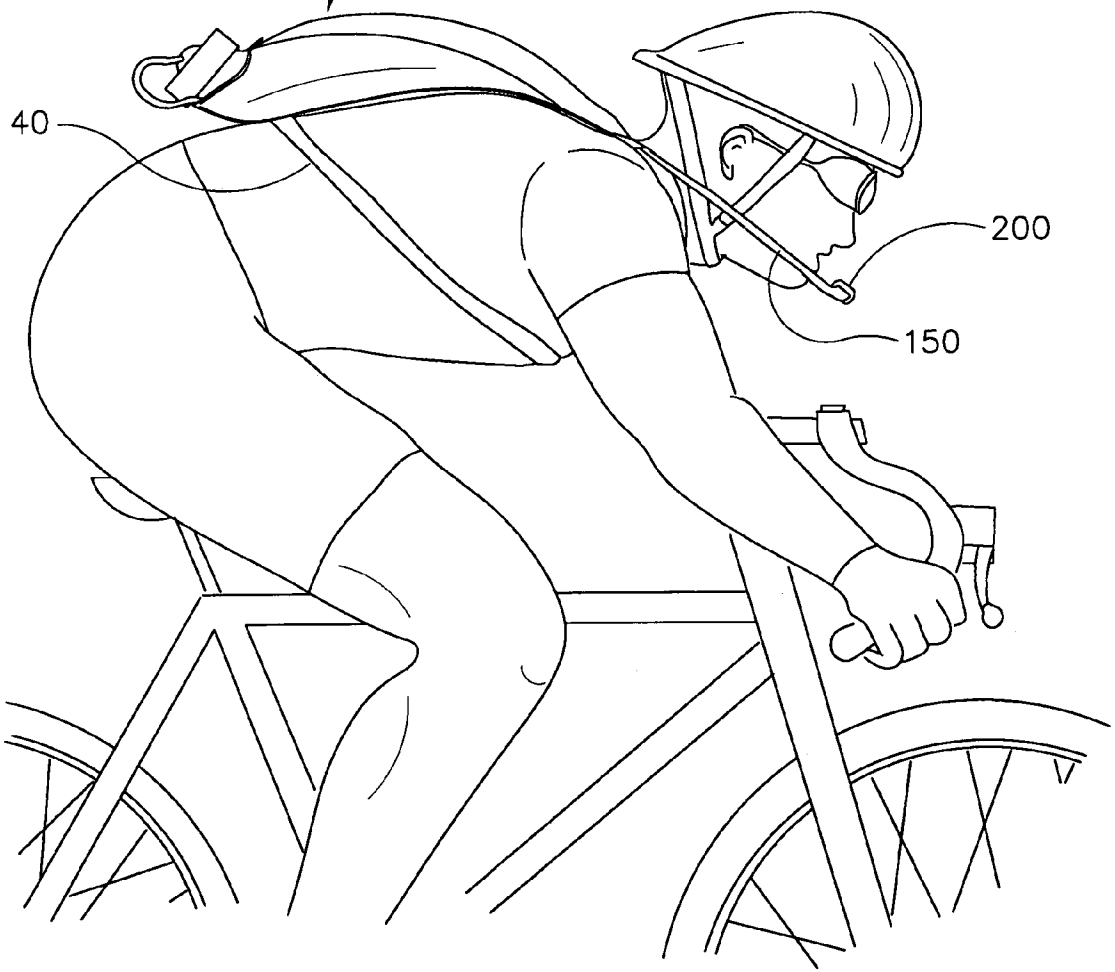
FIG. 1 is a schematic representation of a personal hydration device according to an embodiment and shown in use by a cyclist.

Referring to the FIGURES, the personal hydration system includes (among others) a holder 20, a reservoir 50, and a fluid delivery system 100 to provide fluids to a user. The user may be a person engaged in any activity in which hydration of the user's body is desirable, such as recreation (shown for example as a cyclist in FIG. 1), work or other strenuous activity or where the user is exposed to environments or conditions that tend to dehydrate the user. According to any preferred embodiment, the holder is shown adapted to be worn by, or otherwise attached to, a user and is configured to support the reservoir and the fluid delivery system for providing a supply of a fluid to the user. The fluid may be any fluid type suitable for hydration of a user, such as water, juice or other liquids that may contain sugars, electrolytes, etc. for hydration of the user. The reservoir is shown as configured to be secured by the holder and to store a quantity of the fluid for consumption by the user. The reservoir is formed from a material that is configured to generally retain a predetermined shape that is readily cleanable after use and that is also sufficiently deformable to permit withdrawal of the fluid from the reservoir by the user using reasonable suction pressure. The fluid delivery system is shown to include an interface for interconnecting with the reservoir and providing a flow path for the fluid to be consumed by the user. A mouthpiece and valve system is provided for the user to access the fluid (e.g. orally) and a positioner device is provided to position the mouthpiece at a convenient location proximate the user's mouth (e.g. for "hands-free" operation). The fluid delivery system is intended to provide a sufficiently "airtight" system between the reservoir and the mouthpiece so that when a user draws fluid from the mouthpiece using normal suction pressure, a vacuum formed within the system and reservoir permits the reservoir to deform into a shape having a reduced volume and fluid flows through the mouthpiece to the user. When the user finishes withdrawing fluid from the mouthpiece, air is drawn into the system (e.g. through the mouthpiece, etc.) to sufficiently "equalize" the pressure between the atmosphere and the reservoir and fluid delivery system so that the reservoir returns to its original shape.

Figure 2:
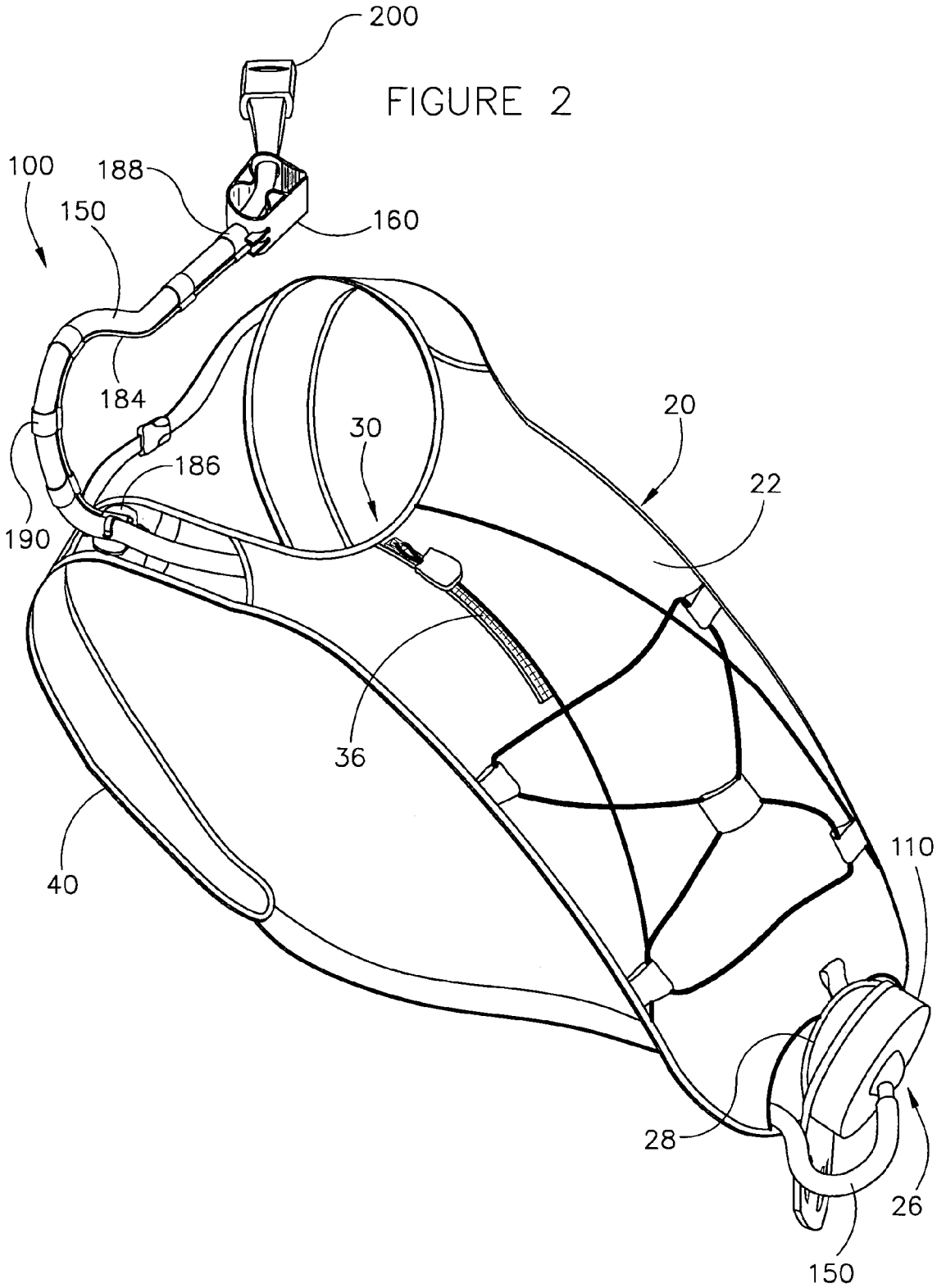
FIG. 2 is a schematic representation of a front perspective view of a personal hydration system according to an embodiment.
Figure 3:
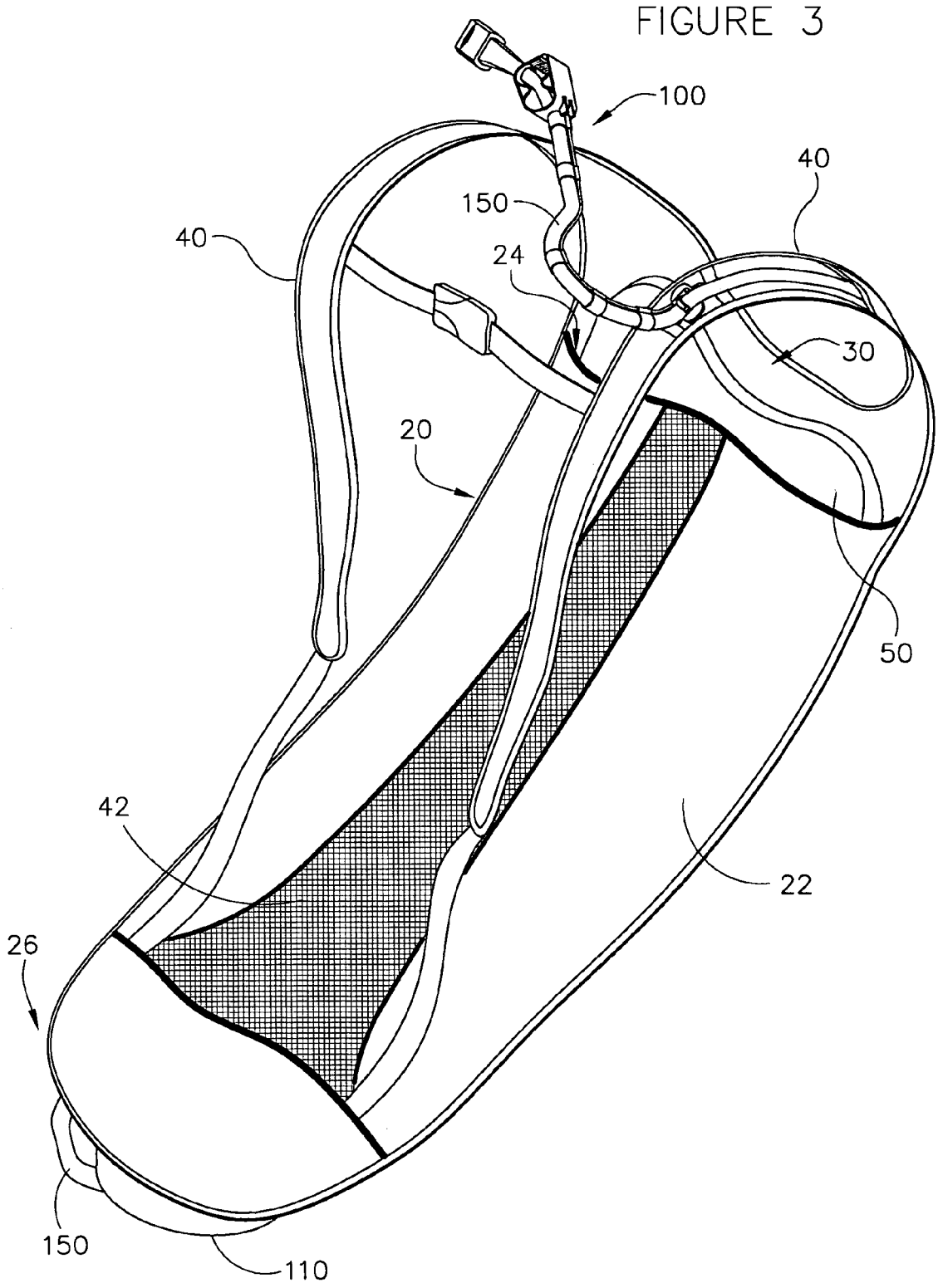
FIG. 3 is a schematic representation of a rear perspective view of the embodiment of a personal hydration system of FIG. 2.
Figure 4:
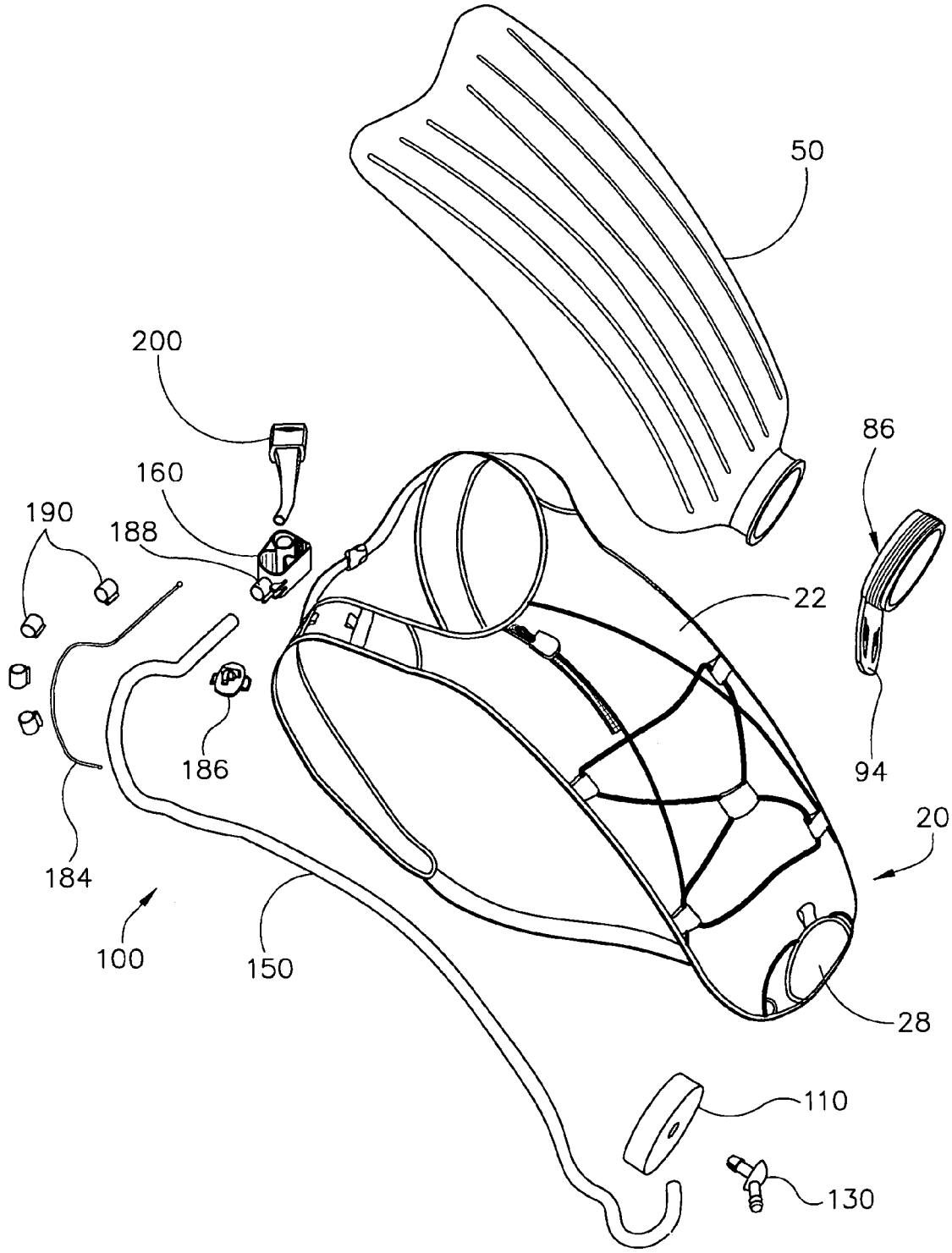
FIG. 4 is a schematic representation of an exploded perspective view of the embodiment of a personal hydration system of FIG. 2.
Figure 5A:
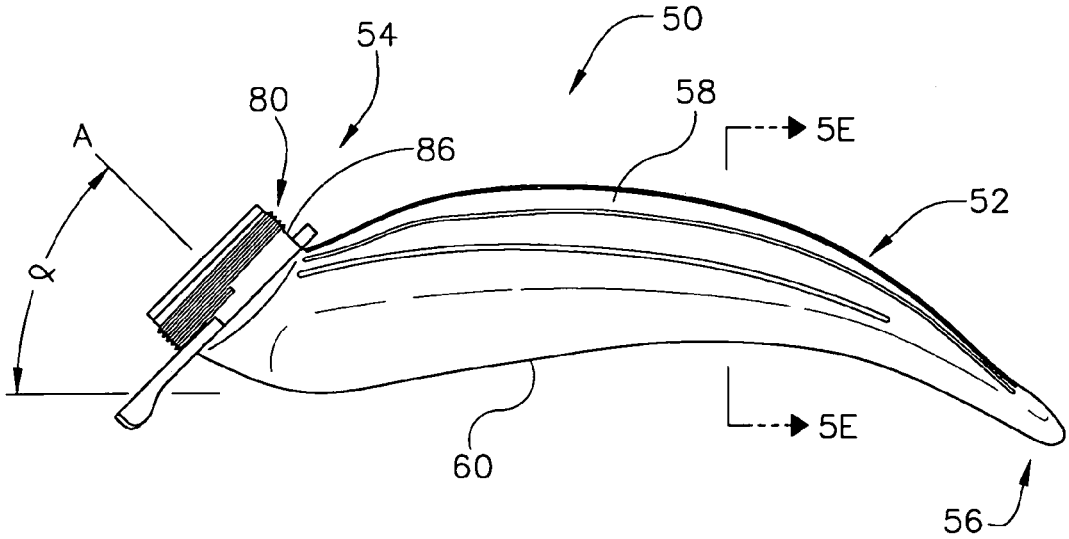
Figure 5B:
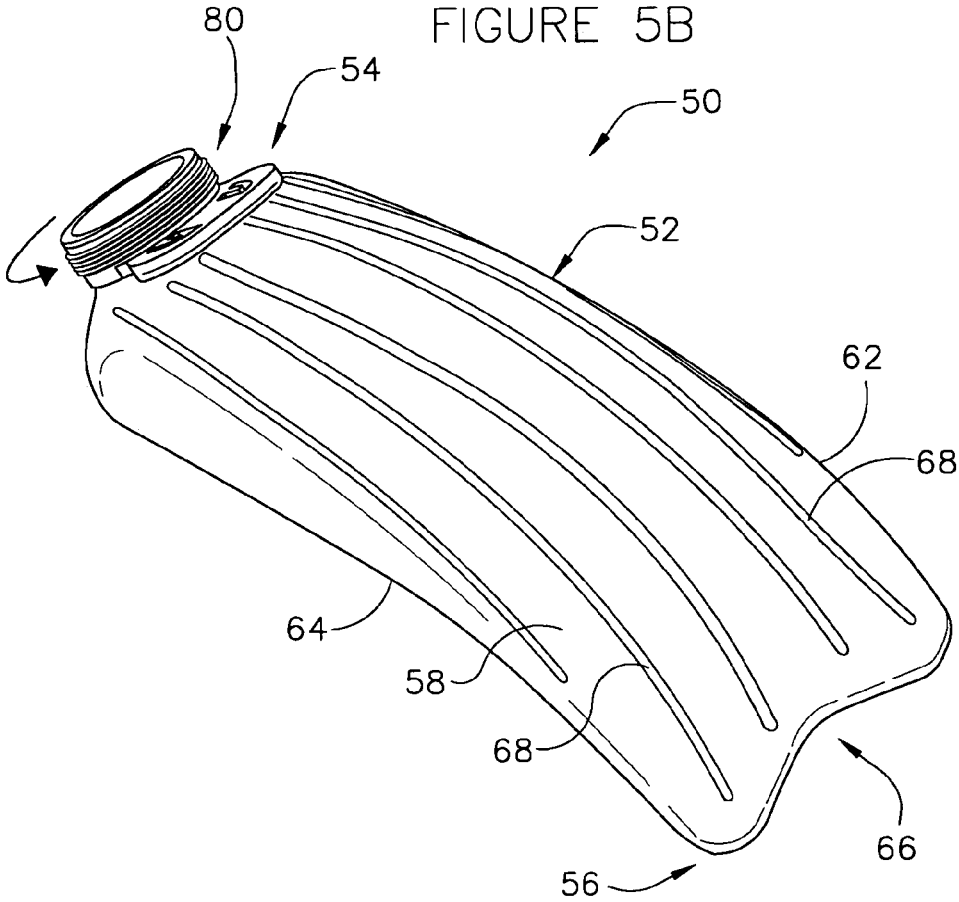

Referring to FIGS. 2-4, the holder 20 (e.g. pack, backpack, harness, carrier, etc.) is shown schematically according to an exemplary embodiment. Holder 20 includes a body portion 22 shown as a sleeve having a compartment for holding the reservoir 50. Body portion 22 includes a first end 26 having an opening 28 (shown as a generally circular opening) configured to permit interconnection of reservoir 50 and fluid delivery system 100. A second end 30 of body portion 22 is shown having an opening for inserting and removing reservoir 50 from the compartment. Second end 30 may include a releasable closure device of a conventional type (e.g. snaps, zipper, latches, Velcro®, etc.) to assist in retaining reservoir 50 within the compartment. Body portion 22 is also shown to include storage devices 36 (e.g. zipper compartments or pockets, elastic cords, etc.) on or within the body that are intended to hold articles of convenience for the user and is intended to improve the utility of the holder. Holder 20 further includes attachment members (shown as adjustable straps 40) extending generally from the first end to the second end of the holder, and configured to accommodate users of various sizes (e.g. "one-size fits-all") to couple the holder to the user. Holder 22 is shown to further include a panel 42 extending from the first end to the second end of the holder and configured to provide a clearance (e.g. gap, space, etc.) between the holder and the user's back and intended to promote air circulation (e.g. ventilation, etc.) between the user and the holder. According to any preferred embodiment, holder 22 is made from lightweight durable materials such as Nylon, Nylon mesh, etc. and may include padding or cushioning at suitable locations to enhance comfort to the user.

Referring to FIGS. 4 and 5A-5E, reservoir 50 (container, storage device, bottle, enclosure) is shown according to an exemplary embodiment. Reservoir 50 is shown including an outer shell portion 52 having a volume for containing the fluid and formed in a generally curved shape having qualities of a desirable type (e.g. aerodynamically, aesthetically, ergonomically, etc.). According to the embodiment, shell 52 of reservoir 50 is formed in a semi-rigid structural shape and is resistant to substantial deformation (e.g. "collapse," "flattening," etc.). The shell is intended to have sufficient stiffness to act as a "frame" for the holder and maintain the shape of the holder when the personal hydration system is used. According to one embodiment, the holder may be provided in the form of a backpack having a compartment for holding the reservoir and also having compartment(s) or storage space for other objects (such as, but not limited to items for camping, hiking, walking, cycling, hunting, etc.) The reservoir has sufficient stiffness to serve as an internal "frame" for the backpack to maintain a desired "shape" or "form" of the backpack. Use of the reservoir as a frame within a backpack is intended to accomplish the dual purposes of providing a fluid storage receptacle and a frame, and to eliminate the need for a separate, additional frame structure within the backpack (e.g. to minimize weight, cost, etc.). As shown in FIGS. 2-4, the reservoir may be configured in the backpack for loading through a "top" of the backpack and having an opening that captures a portion of the reservoir (shown as the neck) at the "bottom" of the pack. However, the reservoir may be configured in any suitable orientation within the backpack to serve as a frame and a fluid storage receptacle.

The semi-rigid structural shape of the reservoir has sufficient rigidity (e.g. firmness, etc.) to substantially minimize deformation of shell 52 when reservoir 50 is filed with fluid (or is filled with a "hot" fluid, etc.), yet has sufficient flexibility (pliability, deformability, etc.) to temporarily deform at least partially into another shape (e.g. of reduced volume) when fluid is being withdrawn by the user. The capability of the shell to partially deform is intended to permit a user to overcome a vacuum that might otherwise be created within the shell when the fluid is withdrawn (e.g. "sucked out" through the generally airtight fluid delivery system, etc.) by the user. Shell 52 has sufficient resiliency so that after fluid is withdrawn by the user, shell 52 returns to its original shape and in so doing, draws air through the fluid delivery system (e.g. through the mouthpiece, etc.) and into the reservoir to generally equalize pressure between the shell and the surrounding atmosphere. According to any preferred embodiment, the shell of the reservoir has sufficient firmness to maintain its shape when fluid is not being withdrawn, and to deform a certain degree to permit relatively easy fluid withdrawal under normal suction pressure by the user, and to return to its original shape (e.g. resiliency, memory, etc.) by drawing air into the volume of the shell after fluid withdrawal (e.g. in a manner somewhat analogous to a "breathing" operation).

Shell 52 of reservoir 50 is shown having a first end 54, a second end 56, a first side 58 and a second side 60. The shape of shell 52 is attributable, in part, to a curvature of the first side 58 and the second side 60. According to the illustrated embodiment, first side 58 is shown having a surface that is at least partially curved (e.g. convex, dome-shaped, etc.) in a first plane (shown schematically in FIG. 5A) and in a second plane (shown schematically in FIG. 5E). Second side 60 is also shown having a surface that is at least partially curved (e.g. convex, dome-shaped, etc.) in a first plane (shown schematically in FIG. 5A), and is intended to generally "fit" or "follow" the curvature or "arch" of a region of the user's back (e.g. thoracic spinal region, etc.) in various positions (e.g. upright as in walking, or inclined or horizontal as in cycling, etc.). The surface of second side 60 is shown at least partially curved in a second plane (shown schematically in FIG. 5E) that is intended to create a passage or channel longitudinally (i.e. from the first end to the second end) to permit circulation of air (e.g. ventilation, etc.) between second side 60 and the user's back along the user's spine. The curved surface in the second plane of second side 60 also forms edge regions 62, 64 extending from first end 54 to second end 56 that are intended to be supported on and at least partially along muscular regions laterally adjacent the user's spine in order to enhance the comfort of the user. Second end 56 of shell 52 is shown having a width intended to fit between the user's shoulder blades and includes a portion that is shown to have a curved surface 66 configured to "fit" or "follow" the back of a user's neckline.

First side 58 is shown to further include ribs 68 (e.g. stiffeners, ridges, etc.) extending longitudinally and intended to optimize the stiffness and resiliency of first side 58. Second side 60 is shown to further include ribs 70 (e.g. stiffeners, ridges, etc.) extending laterally (i.e. generally orthogonal to ribs 68) and intended to enhance the stiffness and resiliency of second side 60. According to one preferred embodiment, the curvature of first side 58 of shell 52 is configured to deform (e.g. "bow" inward) while fluid is withdrawn from reservoir 50 and the curvature of second side 60 is configured to remain substantially unchanged so that the "fit" of second side 60 to a user's back remains substantially constant. After the user finishes withdrawing fluid from reservoir 50, the shape and resiliency of first side 58 tend to cause first side 58 to return (e.g. "spring back," etc.) to its original curvature, drawing air into the shell as the shell returns to its original volume. Shell 52 is also shown to include a projection (shown schematically as a baffle 72) on an interior surface of side 60. One or more baffles may be provided and are intended to arrest or minimize motion or movement of the fluid and to minimize related fluid movement noises (e.g. "sloshing" etc.) during movement or activity by the user for applications where minimizing noise is desirable (e.g. nature watching, hunting, military activities, etc.).

According to an alternative embodiment, a baffle may be a separate device configured to be removably inserted into the shell by the user and configured to minimize motion of the fluid. According to another alternative embodiment, the shell may be substantially rigid and provided with a pressure-equalization device (e.g. check valve, vacuum breaker, etc.) at any suitable location on the shell that permits air to enter the volume of the shell as fluid is withdrawn by the user. According to a further alternative embodiment, the shell may be substantially rigid and provided with a flexible bladder (e.g. that is disposable, etc.) within the shell for containing the fluid in a manner that does not require pressure equalization across the shell as fluid is withdrawn. An airspace separate from the fluid contained in the bladder may be created between an exterior surface of the bladder and an interior surface of the substantially rigid shell so that the air space may be pressurized by the user (e.g. by a bicycle pump, hand pump, etc.) to provide a source of "pressurized" fluid to the user in a manner intended to prevent contamination of the fluid by potential contaminants within the airspace. According to other alternative embodiments, the orientation of the ribs may be provided in any suitable orientation to obtain the desired stiffness characteristics of the shell. Further, the particular curvature of the surfaces of the shell may be varied to enhance any desirable characteristic of the shell (e.g. stiffness, memory, aerodynamic performance, adaptation to physical characteristics of users, etc.).

Referring further to FIGS. 5A-5D and 7, reservoir 50 further includes a conduit (shown schematically as neck portion 80) extending from first side 58 of shell 52 according to the illustrated embodiment. Neck portion 80 is shown having a generally cylindrical cross section having an axis A extending at an angle $\alpha$ from a portion of second side 60 adjacent first end 54. According to one embodiment, angle $\alpha$ is generally within a range of approximately 30 degrees to 45 degrees and is intended to enhance cleanability of the reservoir by permitting direct access for cleaning (e.g. by "sprayers," "bottle-brushes" or the like, etc.) to the interior surfaces of shell 54 and to promote enhanced drainage of cleaning solutions and the like when reservoir is oriented generally vertically with neck portion 80 pointed downward (e.g. such as when placed in a lower rack of a conventional dishwasher). Neck portion 80 has a first end integrally formed with shell 52 to provide a generally smooth internal transition with the shell and a second end shown having a flange 82 (e.g. lip, etc.) configured to interface in a sealing relationship with a portion of the fluid delivery system. According to one embodiment, the neck portion is provided with an internal diameter within a range of approximately two (2) inches to two and one half (2½) inches for receiving a water filtration device (not shown) such as are commercially available from outdoor recreation supply stores and the like for use in providing filtered fluid to the user.

Figure 8:
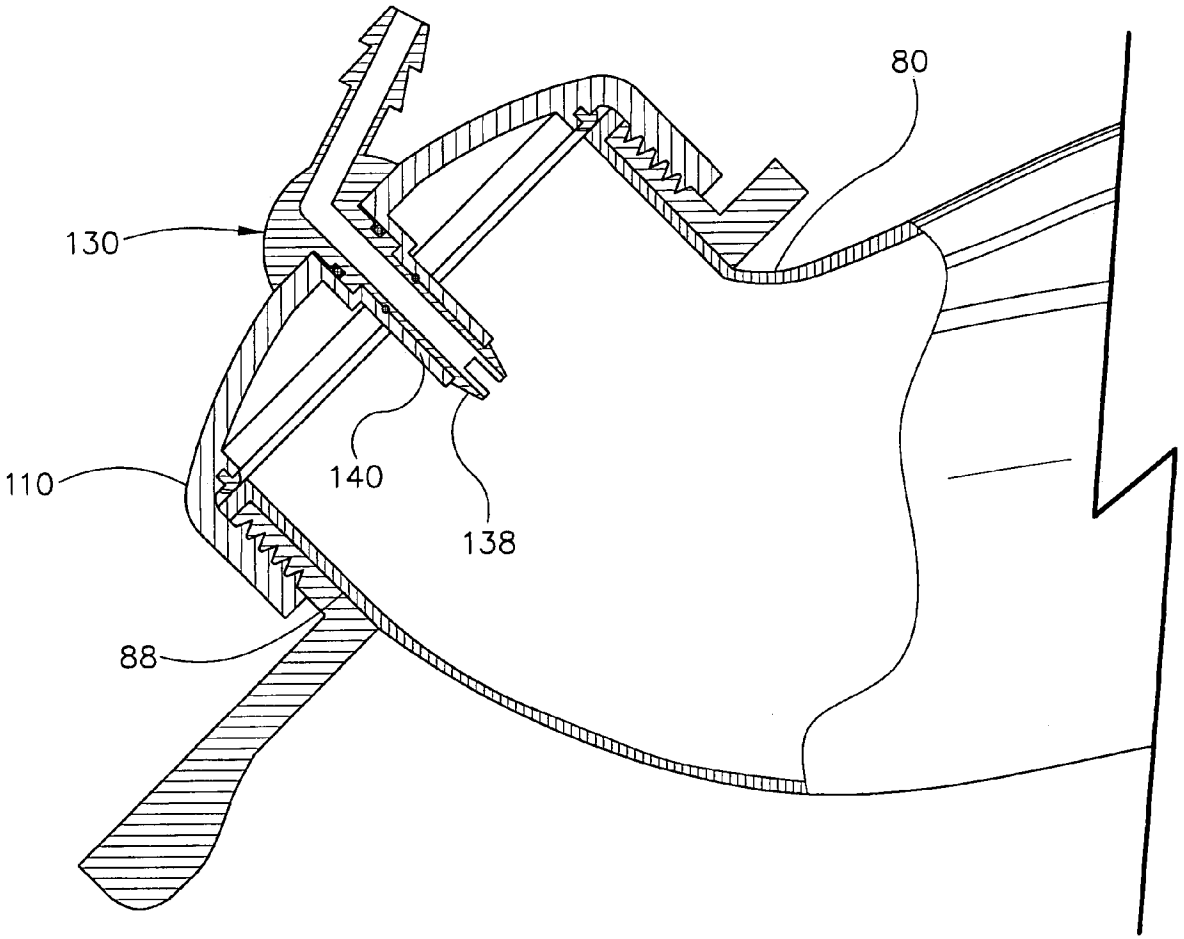
FIG. 8 is a schematic representation of a cross sectional view of a portion of an embodiment of the cap of a personal hydration system.

Referring to FIGS. 2 and 6, a retainer device (e.g. frame, etc.—shown as collar 86) is shown according to an exemplary embodiment. Collar 86 has a generally cylindrical portion 88 having coupling structure (shown schematically as threads 92) and a sealing surface 90 configured to abut an underside of flange 82. Cylindrical portion 88 has a diameter slightly greater than a diameter of neck portion 80 so that collar 86 is rotatable about neck portion 80 and constrained between shell 52 and flange 82. According to one embodiment, collar 86 is configured for installation over flange 82 and onto neck portion 80 by snap-fitting collar 86 over flange 82. The collar is configured to provide a first portion of a sealing interface between the reservoir and the fluid delivery system. The sealing surface 90 on collar 86 is configured to abut the underside of flange 82, and coupling structure 92 on collar 86 is configured to engage a corresponding coupling structure on a second portion of the sealing interface (shown as a cap of the fluid delivery system in FIG. 8). The first and second portions of the sealing interface are configured to be drawn together (e.g. tightened, etc.) to compress (e.g. clamp, squeeze, etc.) flange 82 therebetween to provide a sealing connection between the reservoir and the fluid delivery system that may be readily removed and reconnected. Accordingly, the reservoir may be integrally formed as a single piece in a relatively inexpensive manner (e.g. by blow molding, etc.) from a single material (e.g. low density polyethylene (LDPE), etc.) in order to minimize the expense and complexity of the manufacturing process for the reservoir.

Collar 86 is further shown to include an extension member (shown as a handle 94) having an end region with a downwardly extending protrusion 96. Collar 86 is rotatable about neck portion 80 between a first position (e.g. an installation/removal position as shown schematically in FIG. 5A) and a second position (e.g. locked, retained, etc. as shown schematically in FIG. 5B). Collar 86 may be rotated to the first position and extended through opening 28 in holder 20, followed by neck portion 80, when reservoir 50 is installed in the compartment in the holder. Collar 86 may then be rotated approximately 180 degrees to the second position where handle 94 extends over a portion of holder 20 adjacent opening 28 to resist removal of reservoir 50 from the compartment and protrusions 96 are configured to "compress" or "pinch" or otherwise grip the holder between handle 94 and first side 58 of shell 52 to assist in retaining reservoir 50 within holder 20. Handle 94 is shown to further include tabs 98 (e.g. clips, projections, etc.) that may be useful for temporarily attaching items (such as components of the fluid delivery system) during cleaning activities (such as placement within a conventional dishwasher). According to an alternative embodiment, the reservoir may be formed from any suitable material such as high density polyethylene (HDPE) or other plastic material having sufficiently low leach rate properties.

Referring to FIGS. 4 and 7A-14A, the fluid delivery system 100 is shown according to the illustrated embodiment for providing a flow path and flow control devices to deliver fluid from the reservoir to the user. Fluid delivery system 100 is shown and described according to the illustrated embodiment as a gravity-type or suction-type fluid delivery system for use with reservoir 50. However, a forced-type fluid delivery system may also be provided with the personal hydration system, including a pump (e.g. a peristaltic-type pump, or a pump driven by an electric, mechanical or electromechanical motor, which may be activated by a mouth-activated switch) as shown and described in U.S. patent application Ser. No. 10/653,011 titled "Personal Hydration System With Pump" filed on Aug. 28, 2003 and incorporated by reference in its entirety herein.

Fluid delivery system 100 is shown to include a cap 110, a tube coupling device 130, a tube 150, a mouthpiece 200, a clamp 160 and a positioning system 180. As shown schematically in FIGS. 7A-7B and 8, cap 110 (cover, closure, etc.) has coupling structure 112 configured to engage coupling structure 92 on collar 86. Cap 110 further includes a sealing membrane 114 (e.g. gasket, o-ring, etc.) configured to seal against at least one of a top surface of flange 82 and sealing surface 90 of collar 86, so that when cap 110 is coupled to collar 86, a substantially leak-free connection can be achieved by clamping flange 82 therebetween.

Fluid delivery system 100 further includes a tube coupling device 130 (e.g. spigot, elbow, union, tube-cap interface, etc.—shown schematically in FIG. 7C) configured to rotatably coact with cap 110 so that cap 110 may be threaded on to collar 86. Tube coupling device 130 is shown including a first section 134 rotatable within cap 110 and a second section 136 configured to connect with tube 150. First section 134 includes resilient projections (shown as prongs 138) that extend through and engage an end of a passage 140 within cap 110 intended to couple and retain tube coupling device 130 to cap 110. First section 134 further includes at least one o-ring (shown schematically for example as two o-rings 142) intended to provide a seal between first section 134 and passage 140 of cap 110, so that cap 110 may be rotated relative to first section 134 in a substantially leak-free manner. Second section 136 of tube coupling device 130 is connectable to a first end 152 of tube 150 (shown schematically in FIGS. 2 and 4) and includes retainers 144 (shown as ridges or "barbs") intended to retain tube 150 on second section 138.

Referring further to FIGS. 10A-14B, a mouthpiece 200 for a fluid delivery system is shown according to the illustrated embodiment. Mouthpiece 200 is connected to a second end 154 of tube 150 for location proximate the user's mouth so that the user may withdraw fluid from the reservoir, through the mouthpiece, in a hands-free manner.

Mouthpiece 200 includes a mouth-actuated valve that operates to permit flow of the fluid when the shape of an opening or aperture (e.g. a slit, etc.) in the mouthpiece is transformed (e.g. "deformed") by the mouth of the user. Mouthpiece 200 is intended to overcome problems associated with conventional "bite valves." For example, mouthpiece 200 as shown is intended to be easily disassembled to provide easy access to the interior of the mouthpiece for cleaning. Mouthpiece 200 is shown to include relatively thin walls and a construction intended to prevent the complete closing of the flow area under increased clamping by the user, so that the mouthpiece will not restrict flow in the event that the user provides increased force on the mouthpiece to actuate the valve.

Referring to FIG. 10A mouthpiece 200 as shown includes a body portion 202 and a valve cap portion 204. Mouthpiece 200 is shown having a generally elongated shape extending from a fluid inlet end 206 of body portion 202 to a diaphragm 208 (e.g. membrane, end wall, etc.) having a reclosable aperture shown as a transversely elongated slit 210 (e.g. linear opening, etc.) at a fluid outlet end of valve cap portion 204. Elongated slit 210 in diaphragm 208 includes a first end 212 and a second end 214.

According to any preferred embodiment, body portion 202 and valve cap portion 204 are formed from resilient, deformable materials, including, but not limited to, silicone, polymer or latex. Fluid inlet end 206 of the mouthpiece includes a stretchable connecting portion 290 configured to be stretched over second end 154 of tube 150 to provide a substantially leak-free connection for receiving fluid from reservoir 50, and that is removable from tube 150 (e.g. for cleaning, repair, replacement, etc.). Valve cap portion 204 and a portion of body portion 202 of the mouthpiece are configured to be placed within a user's mouth for actuation of the valve and to draw fluid from the reservoir and through the fluid delivery system for consumption by the user.

Mouthpiece 200 is configured to function as a valve for dispensing liquid through slit 210 by transformation between a first shape (i.e. "undeformed") where slit 210 is closed to prevent flow of fluid (as shown in FIGS. 10A-10B) and a second shape (i.e. "deformed") where slit 210 is opened to permit flow of fluid (as shown in FIG. 10C). Mouthpiece 200 is configured to be transformed between the first shape and the second shape (i.e. "deformed") by the user (e.g. by biting, compressing between the lips, etc.), so that opposing sides of valve cap portion 204 adjacent to first end 212 and second end 214 of slit 210 are moved towards one another, to actuate the valve by opening slit 210 (e.g. by separation of the adjacent side of the slit, such as in a "fishmouth" configuration, etc.) and allowing the user to draw liquid from reservoir 50.

Figure 11B:
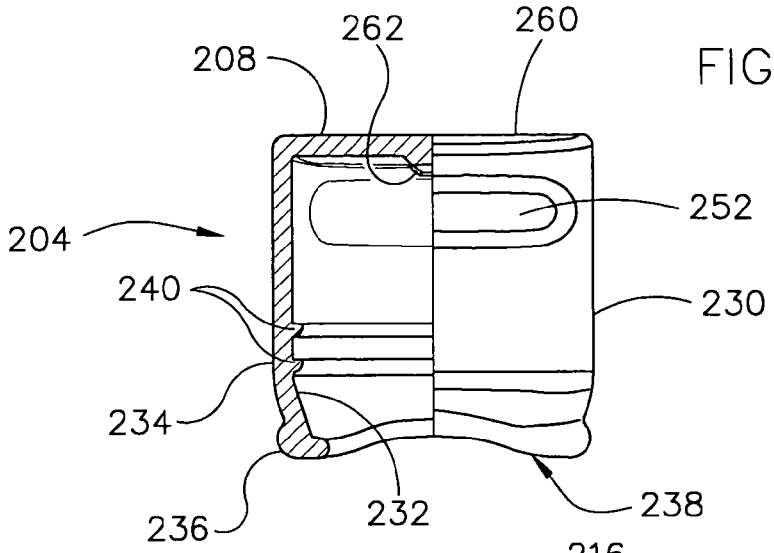
FIGS. 11A-11B are a schematic representation of a partial sectional view of the embodiment of FIGS. 10A-10C.
Figure 11A:
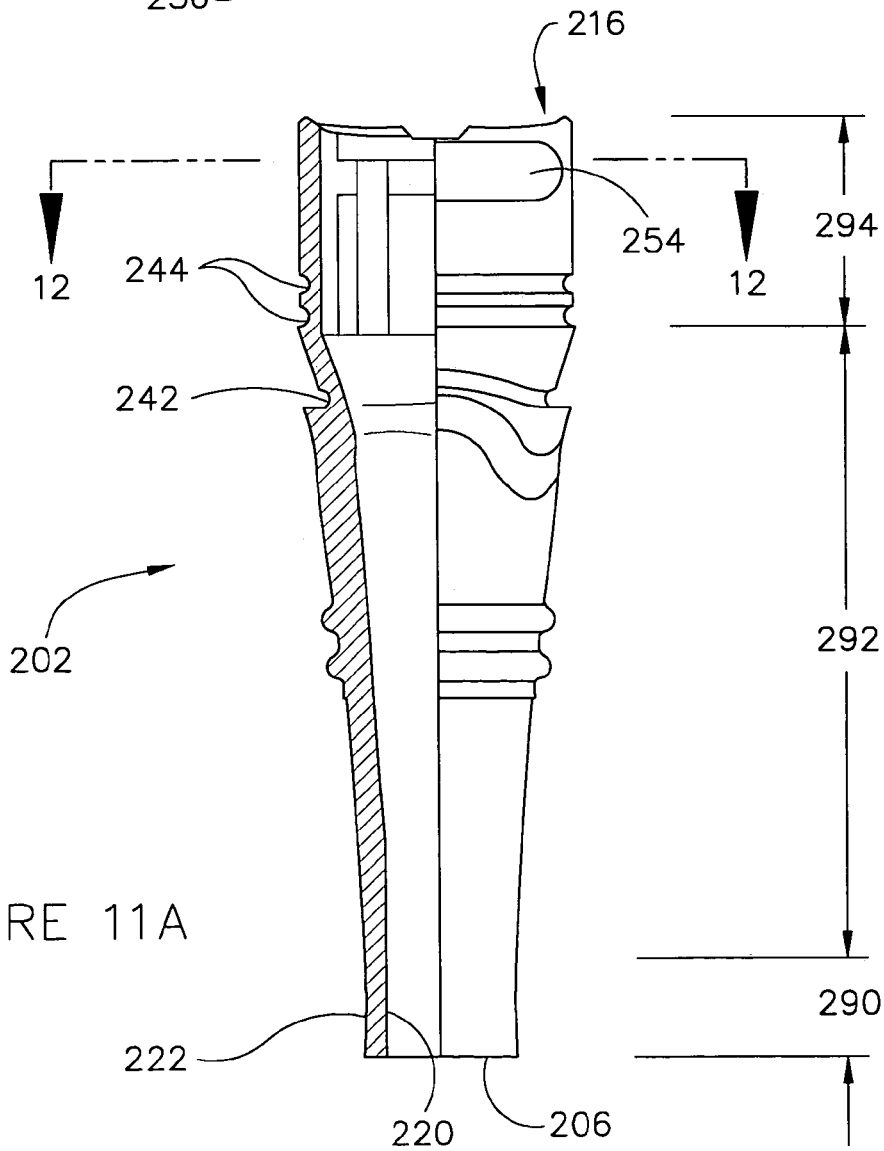

Referring to FIGS. 11A-11B and 14A-14B, mouthpiece 200 is shown in further detail. Body portion 202 is shown in FIGS. 11A and 14A, and valve cap portion 204 is shown in FIGS. 11B and 14B. In FIGS. 11A and 14A, the right side of each FIGURE is an orthogonal view, and the left side of each FIGURE is a sectional orthogonal view taken through the center of the mouthpiece. Body potion 202 and valve cap portion 204 are configured to be interconnected to form mouthpiece 200 (e.g. by stretching/sliding valve cap portion 204 over body portion 202). A seal is formed by contact between the body portion and the valve cap portion and their interconnecting surfaces (to be described in further detail).

Referring to FIG. 11A, body portion 202 is shown having an elongated, hollow shape with an inner surface 220 and an outer surface 222, extending between first end 206 (e.g.: inlet end) and a second end 216 (e.g. outlet end). Body portion 202 is further shown to include inlet portion 290 adjacent first end 206, an outlet portion 294 adjacent second end 216, and a transition portion 292 between inlet potion 290 and outlet portion 294. According to a preferred embodiment, the length of body portion 202 between first end 206 and second end 216 is at least one and one-half (1½) inches. As viewed in a transverse plane that is perpendicular to elongated body potion 202, the shape of the body portion defined by inner surface 220 and outer surface 222 changes from a generally circular section at inlet portion 290 to a generally rounded-edged, rectangular-like section at outlet portion 294 (also shown in FIG. 12). The internal, transverse area of transition portion 292 as defined by that portion of inner surface 220 is shown to increase between inlet portion 290 and outlet portion 294, while the internal, transverse shape of inner surface 220 changes from the generally circular section at first end 206 to the generally rectangular-like section at second end 216.

Valve cap portion 204 includes diaphragm 208, which is shown to include slit 210, and a side wall 230 having an inner surface 232 and an outer surface 234. Outer surface 234 of valve cap 204 thus forms an outer valve surface 250. Inner surface 232 and outer surface 234 meet to form a circumferential lip 236. Lip 236 defines an aperture 238 in valve cap portion 204 shown at the end opposite diaphragm 208. Inner surface 232 is also shown to include a plurality of ridges 240 (shown schematically as two ridges). Valve cap portion 204 is configured to interconnect with body portion 202 when aperture 238 of valve cap portion 204 is pulled over second end 216 and over outlet portion 294 towards transition portion 292 of body portion 202. The shape of diaphragm 208 is configured to generally correspond to the rectangular-like shape of second end 216, and wall 230 is shown to conform with the outer surface of body portion 202. When valve cap portion 204 is assembled on body portion 202, wall 230 is shown to extend over outlet portion 294 and a part of transition portion 292 with a circumferential groove 242 adapted to receive lip 236. A pair of circumferential grooves 244 are provided in on body portion 202 to receive ridges 244. Lip 236 is also intended to facilitate installation and removal of valve cap portion 204 from body portion 202.

Referring further to FIGS. 11A and 11B, outer valve surface 250 is shown schematically to include a pair of external depressions 252 (e.g. recesses, etc.—shown on opposing sides of the valve surface, adjacent to first end 212 and second end 214 of slit 210) that are intended to serve as a "locator" for the user's mouth to facilitate operation of the valve by the user. Body portion 202 has corresponding indentations 254 configured to accommodate depressions 252 of the valve cap portion 204 when mounted on body portion 202. Body portion 202 is shown to include ridges (shown as two ridges 288) configured to locate or otherwise accommodate a clamp device (such as clamp 160 to be further described).

Diaphragm 208 preferably includes a ridge 260 that protrudes away from side wall 230 and that is generally perpendicular to and bisects slit 210 (shown schematically in FIG. 10A). According to one embodiment, diaphragm 208 has a substantially constant thickness, except for a relatively narrow section 262 provided on either side of slit 210 having an increased thickness that protrudes into valve cap portion 204. Sections of increased thickness 262 are intended to bias (e.g. force, etc.) the opposing sides of slit 210 together in the first undeformed state (shown schematically in FIG. 10A-10B.

Referring further to FIGS. 10B and 10C, the operation of mouthpiece 200 as a valve is shown according to one embodiment. Mouthpiece 200 in shown in a first (i.e. "undeformed") position in FIG. 10B corresponding to a valve-closed position and in a second (i.e. "deformed") position in FIG. 10C corresponding to a valve-opened position. The portions of outer valve surface 250 adjacent the ends 212 and 214 of slit 210 are indicated as surface 270 and 272. When surfaces 270 and 272 are forced inwardly (e.g. together, as indicated by arrows F shown in FIG. 10C), slit ends 212 and 214 are brought towards one another, and slit 210 opens to create an open area 268 for passage of fluid.

Ridge 260 and sections of increased thickness 262 also cooperate to open slit 210 during operation of the valve to create area 268 so that fluid may flow from the reservoir, through the tube, through the mouthpiece and diaphragm wall of the valve, and into the user's mouth according to the pressure difference between the reservoir and the user's mouth. This pressure difference can result from suction applied by the user against the pressure within the reservoir. Accordingly, one method for a user to draw fluid is to compress the mouthpiece and valve cap in his/her teeth or lips to open slit 340 and then create a suction to draw fluid from the reservoir.

Referring further to FIGS. 10A and 10B, when diaphragm 208 is in the undeformed position, slit 210 is biased to a closed position (e.g. shut) by the structure of valve cap portion 204 which is intended to provide a spring-like force incorporated into the flexible structure of walls 250. Despite the inherent stiffness associated with structure, the structure is intended to be operated by a level of force that is comfortable for the user (i.e. by biting the mouth piece), as the bridges formed by the top and bottom walls are relatively easily deformed due to the length of slit 210.

Mouthpiece 200 is also configured to resist deformation to an extent that flow may be unduly restricted through the mouthpiece (as shown schematically in FIGS. 12 and 13A-13B). FIG. 12 is a perspective sectional view along line 12-12 of FIG. 11A of body portion 300. FIGS. 13A and 13B are an orthogonal sectional views along line 12-12 of FIG. 11A, where FIG. 13A shows body portion 202 in the undeformed position (corresponding to the valve-closed position shown schematically in FIGS. 10A and 10B), and FIG. 13B shows body portion 202 in a deformed position (corresponding to the valve-opened position shown schematically in FIG. 10C, but shown open to a more extreme configuration for illustration).

Two projections (shown schematically as ridges or ribs 280 and 282 are shown extending longitudinally along inner body surface 220 from second end 216 that are shown to run along a top surface. According to a preferred embodiment, ribs 280 and 282 extend a substantial length along outlet portion 294. Referring to FIG. 13B, under the application of a force (shown as force F, such as a biting action by the user) ribs 280 and 282 contact opposing portions of surface 220 (i.e. along a bottom surface) intended to prevent the hollow body portion 202 from completely collapsing by forming flow areas 284. According to any preferred embodiment, when slit 210 is opened, ribs 280 and 282 are intended to prevent the mouthpiece cavity from completely collapsing during operation so that flow of fluid through the mouthpiece is not unduly restricted. Ribs 280 and 282 are also intended to optimize the opening of slit 210 to a maximum position for flow passage and to facilitate the formation of an opening in the mouthpiece for flow passage that has approximately the same area as the tube.

The length of transition portion 208 is intended to allow mouthpiece 200 to fit into the user's mouth comfortably, while maximizing the flow potential of the mouthpiece. The length of transition portion 292 is also intended to provide a clamping location for a clamp (to be further described) which may be used as an additional shut-off device (e.g. valve, etc.). In general, the clamp is intended for use to positively stop flow through the tube when fluid flow is not required (e.g. when the personal hydration system is not in use). According to a preferred embodiment, the thickness of transition portion 292 is shown to increase with distance from first end 206 and is intended to stiffen the body portion.

Referring further to FIG. 4, a positioning system 180 for the mouthpiece of the fluid delivery system is shown according to an exemplary embodiment. Positioning system 180 is intended to permit the user to position the mouthpiece in a desired location (e.g. proximate the mouth when hands-free operation is desired, or away from the mouth when hands-free operation is not desired, etc.). Positioning system 180 is shown to include an elongated positioning member 184 (e.g. support member), a first end clip 186, a second end clip 188, and a plurality of intermediate clips 190. First end clip 186 is coupled to a relatively fixed location associated with the user (shown schematically in FIGS. 2 and 4 as coupled to a strap 40 of holder 20) to provide a "base" or "anchor" for positioning system 180. A first end of elongated positioning member 184 is shown fixed to first end clip 186. Elongated positioning member 184 (shown schematically as a wire) extends along tube 150 and is interconnected to the tube at intermediate locations along the tube. The second end of elongated positioning member 184 is shown fixed to second end clip 188 proximate mouthpiece 200. Elongated positioning member 184 is preferably formed from a malleable material such as copper having a round cross sectional shape with sufficient stiffness to hold the tube and mouthpiece with fluid therein in a desired position, yet having sufficient flexibility to permit repeated repositioning of the mouthpiece over prolonged periods of time, and provided with a resilient coating such rubber or plastic (e.g. heat-shrink type tubing, or jacket, etc.).

According to alternative embodiments, the elongated positioning member may be formed from any suitable material (or combinations of materials) and in any desired cross sectional shape, with or without a coating as desired to suit a particular application. According to other alternative embodiments, the elongated positioning member may be interconnected to the tube in any other suitable manner, such as formed with the tube, etc., and provided at any other desirable location along the tube, and fixed or anchored to any other base locations, such as the reservoir or directly to the user.

Figure 9A:
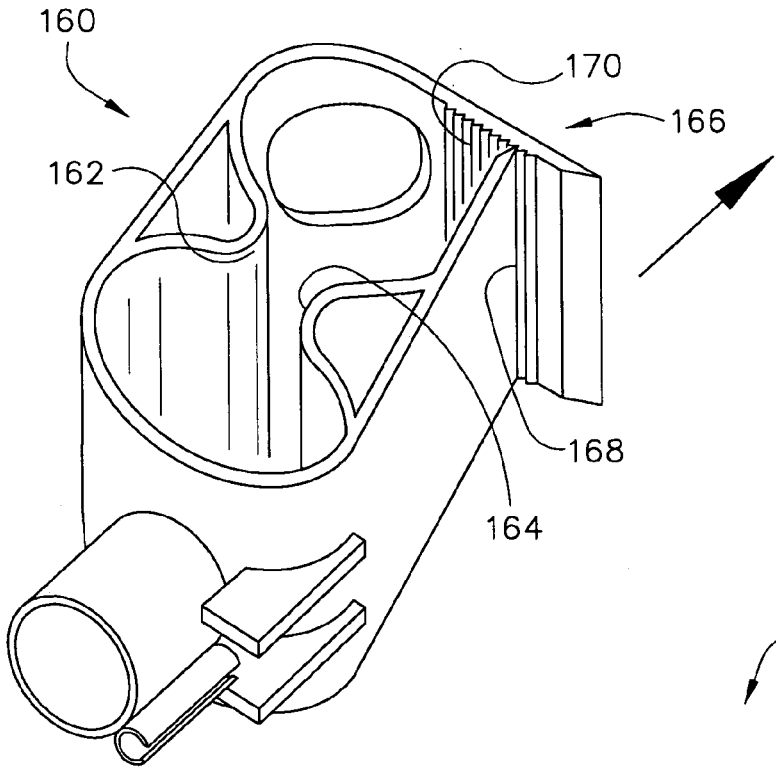
FIG. 9A-9B are schematic representations of a perspective view of a portion of a personal hydration system according to an embodiment.
Figure 9B:
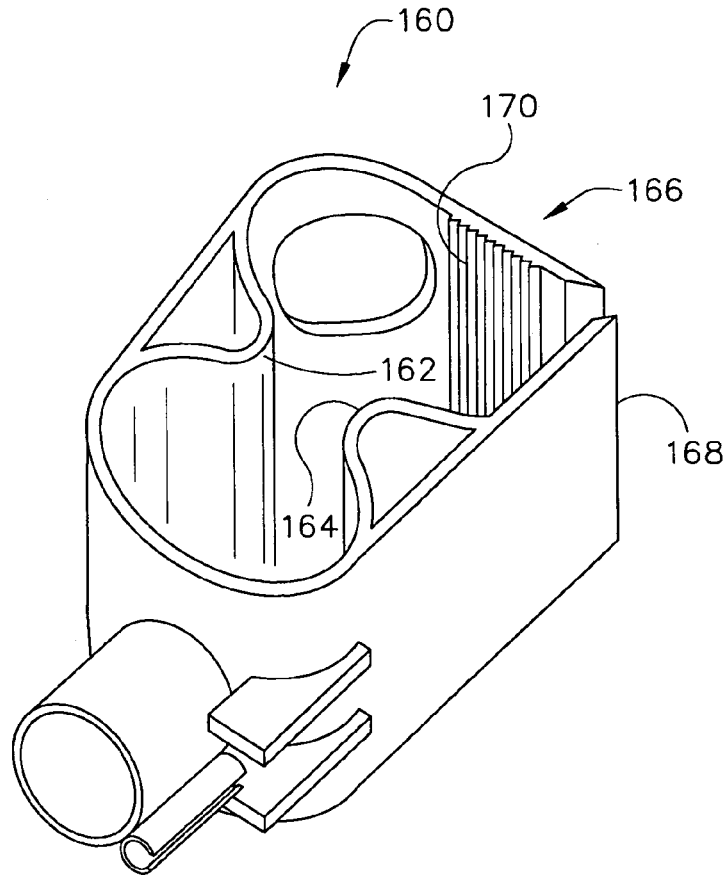

Referring to FIGS. 9A-9B, fluid delivery system 100 may be provided with a manually actuatable flow restricting device (shown schematically as a clamp 160) according to an exemplary embodiment. Clamp 160 is shown coupled to second end clip 188 of fluid delivery system 100 so that the clamp engages a portion of the mouthpiece. Clamp 160 includes opposed clamping surfaces 162, 164 (e.g. ears, etc.) configured to clamp the mouthpiece therebetween. A releasable catch 166 is shown integrally formed with the clamp and includes a projection 168 (prong, barb, pawl, etc.) on a first end configured to coact with a series of ridges 170 (e.g. teeth, ratchet, etc.) on a second end of the clamp and intended for one-handed operation by the user (such as with gloves on, etc.), for example, by lifting the second end to unclamp or by squeezing the first end to clamp). According to an alternative embodiment, the clamp may be positioned to engage the tube at any desired location along the tube.

According to any preferred embodiment, the present invention provides a reservoir that has sufficient stiffness to resist deformation when fluid is not being withdrawn, but has sufficient flexibility to permit a degree of deformation that is intended to permit fluid withdrawal without application of excessive suction by the user. The present also includes a fluid delivery system with a positioning system configured to locate the mouthpiece in a desired location by the user. The present invention also includes a mouthpiece device with a valve cap for providing improved operation of a mouth-actuated valve. The present invention also includes a mouth piece that is readily cleanable, easily operable, and has internal ridges intended to prevent flow from being restricted in the event that excessive opening force is applied to the mouthpiece.

It is important to note that the construction and arrangement of the elements of the personal hydration system provided herein are illustrative only. Although only a few exemplary embodiments of the present invention have been described in detail in this disclosure, those skilled in the art who review this disclosure will readily appreciate that many modifications are possible in these embodiments (such as variations in features such as components, materials, thicknesses, capacities, shapes, dimensions, proportions and configurations of the holder, reservoir, and fluid delivery system, etc. without materially departing from the novel teachings and advantages of the invention. For example, while the present invention describes the use of a single, straight slit for in the diaphragm, slits of other shapes, or multiple slits may be used. In addition, a pair of straight ridges are described within the body portion to prevent collapse of the mouthpiece from obstructing the flow path. Alternatively, other shapes consistent with the deformation of the mouth piece during operation are within the scope of the present invention. In addition, the reservoir is shown having first and second sides with surfaces curved in two planes. Alternatively, the surfaces of the reservoir may be provided in any desirable shape or contour to achieve optimum performance of the reservoir. Further, it is readily apparent that variations of the personal hydration system and its components and elements may be provided in a wide variety of types, shapes, sizes and performance characteristics. Accordingly, all such modifications are intended to be within the scope of the invention.

The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating configuration and arrangement of the preferred and other exemplary embodiments without departing from the spirit of the inventions as expressed in the appended claims.

What is claimed is:

1. A personal hydration system for delivering a fluid for consumption by a user, comprising:

a semi-rigid reservoir;

a holder configured to receive the reservoir and couple to a user;

a fluid delivery system having a tube member with a first end interfacing with the reservoir and a second end configured to be disposed proximate a user to transport fluid from the reservoir to the user; and a positioner device coupled to the tube member and configured to permit the second end of the tube member to be reconfigurable in various positions proximate the user's mouth for consumption of fluid; the positioner device including an elongated member having a first end coupled to the holder and comprising a malleable material.

2. The system of claim 1 wherein the reservoir comprises a first end and a second end and further comprises a neck portion disposed proximate the first end.

3. The system of claim 2 wherein the neck portion further comprises a flange member.

4. The system of claim 3 further comprising a retainer movable about the neck portion between a first position and a second position.

5. The system of claim 4 wherein the retainer is movable to the first position to facilitate installation of the reservoir in the holder and is movable to the second position to retain the reservoir within the holder.

6. The system of claim 5 wherein the retainer is configured to compress a portion of the holder when the retainer is in the second position.

7. The system of claim 4 wherein the retainer further comprises a collar surrounding the neck portion and having a shoulder configured to engage a first side of the flange member.

8. The system of claim 7 further comprising a cap having a sealing surface and configured to releasably engage the collar for compression of the sealing surface against at least one of the shoulder and a second side of the flange member.

9. The system of claim 1 wherein the elongated member comprises a wire.

10. The system of claim 1 further comprising a plurality of clips configured to interconnect the elongated member and the tube member.

11. The system of claim 1 further comprising a mouthpiece coupled to the second end of the tube member.

12. The system of claim 11 further comprising a clamp member having opposed surfaces configured to compress at least one of the tube member and the mouthpiece therebetween.

13. The system of claim 12 wherein the clamp member further comprises a projection configured to coact with a series of ridges to provide a releasable lock structure.

14. A personal hydration system for delivering a fluid for consumption by a user, comprising:

a semi-rigid reservoir having a first end and a second end and a neck portion disposed proximate the first end;

a holder configured to receive the reservoir and couple to a user;

a retainer movable about the neck portion between a first position to facilitate installation of the reservoir in the holder and a second position to retain the reservoir within the holder; and a fluid delivery system interfacing with the reservoir to provide a flow path configured to transport fluid from the reservoir to the user.

15. The system of claim 14 wherein the retainer is configured to compress a portion of the holder when the retainer is in the second position.

16. The system of claim 14 wherein the retainer further comprises a collar surrounding the neck portion.

17. A personal hydration system for delivering a fluid for consumption by a user, comprising:

a semi-rigid reservoir having a collar with a lip;

a holder configured to receive the reservoir and couple to a user;

a fluid delivery system having a tube member with a first end interfacing with the reservoir and a second end configured to be disposed proximate a user to transport fluid from the reservoir to the user, the fluid delivery system also including a leaktight coupling comprising a cap configured to couple to the collar and compress the lip; and a positioner device coupled to the tube member and configured to permit the second end of the tube member to be reconfigurable in various positions proximate the user's mouth for consumption of fluid.

18. A personal hydration system for delivering a fluid for consumption by a user, comprising:

a semi-rigid reservoir comprising a curved profile having a first side and a second side extending between a first end and a second end, and a first space between the first side and the second side proximate the first end that is greater than a second space between the first side and the second side proximate the second end;

a holder configured to receive the reservoir and couple to a user;

a fluid delivery system having a tube member with a first end interfacing with the reservoir and a second end configured to be disposed proximate a user to transport fluid from the reservoir to the user; and a positioner device coupled to the tube member and configured to permit the second end of the tube member to be reconfigurable in various positions proximate the user's mouth for consumption of fluid.

19. The system of claim 17 further comprising a tube interface device rotatably coupled to the cap and having a first segment communicating with the reservoir and a second segment coupled to the tube member.

20. The system of claim 19 wherein the first segment of the tube interface further comprises prongs for releasably coupling the tube interface to the cap.

21. The system of claim 19 wherein the first segment further comprises at least one o-ring for configured to create a seal between the first segment and the cap.

22. The system of claim 18 wherein the first side is at least partially curved along a first plane and a second plane.

23. The system of claim 22 wherein the second side is at least partially curved along the first plane and the second plane.

24. The system of claim 18 wherein the first side comprises a plurality of ribs formed therein and extending in a first direction.

25. The system of claim 24 wherein the second side comprises a plurality of ribs formed therein and extending in a second direction substantially orthogonal to the first direction.

* * * * *